US010329048B2

(12) United States Patent
Nelson et al.

(10) Patent No.: US 10,329,048 B2
(45) Date of Patent: Jun. 25, 2019

(54) STACKABLE PAPERBOARD CONTAINER

(71) Applicant: JAJAC, Ltd., Carlisle, PA (US)

(72) Inventors: J. David Nelson, Summit Point, WV (US); Edwin Schimmel, Lancaster, PA (US); Kevin Grubbs, Gardners, PA (US)

(73) Assignee: JAJAC, Ltd., Carlisle, PA (US)

( * ) Notice: Subject to any disclaimer, the term of this patent is extended or adjusted under 35 U.S.C. 154(b) by 131 days.

(21) Appl. No.: 15/407,763

(22) Filed: Jan. 17, 2017

(65) Prior Publication Data

US 2018/0201402 A1 Jul. 19, 2018

(51) Int. Cl.

| | |
|---|---|
| ***B65D 5/00*** | (2006.01) |
| ***B65D 5/20*** | (2006.01) |
| ***B65D 5/42*** | (2006.01) |
| ***B65D 5/488*** | (2006.01) |
| ***B65D 5/44*** | (2006.01) |
| ***B65D 5/468*** | (2006.01) |

(52) U.S. Cl.

CPC ..... *B65D 5/443* (2013.01); *B65D 5/0045* (2013.01); *B65D 5/20* (2013.01); *B65D 5/4266* (2013.01); *B65D 5/4295* (2013.01); *B65D 5/4608* (2013.01)

(58) Field of Classification Search

CPC ..... B65D 5/003; B65D 5/20; B65D 5/4266; B65D 5/4295; B65D 5/443; B65D 5/4608; B65D 5/30; B65D 5/0045; B65D 5/0254; B65D 5/0035

USPC ..... 229/117.05, 174, 143, 149, 147, 120, 229/148, 153, 915

See application file for complete search history.

(56) References Cited

U.S. PATENT DOCUMENTS

| | | | | |
|---|---|---|---|---|
| 3,034,697 | A * | 5/1962 | Frankenstein | B65D 5/2009 229/167 |
| 4,058,249 | A * | 11/1977 | Buck | B65D 5/0035 206/509 |
| 4,702,409 | A * | 10/1987 | Osborne | B65D 5/003 206/815 |
| 7,467,743 | B1 * | 12/2008 | Philips | B65D 5/0045 229/169 |
| 8,393,470 | B2 * | 3/2013 | Philips | B65D 5/685 206/512 |
| 8,728,270 | B2 | 5/2014 | Schuelke et al. | |
| 2005/0040217 | A1 * | 2/2005 | Fry | B65D 5/0015 229/164 |

(Continued)

*Primary Examiner* — Christopher Demeree
(74) *Attorney, Agent, or Firm* — Barley Snyder

(57) ABSTRACT

A stackable paperboard container is provided and includes a bottom panel, a pair of side panels, a pair of end panels, a pair of side flaps, and a pair of top walls. The pair of side panels extend from the bottom panel and are foldable about a side panel fold line. The pair of end panels extend from the bottom panel and are foldable about an outer end fold line. Each side flap extends from one of a pair of side panels and is foldable about a side flap fold line. Each top wall extends from one of pair of end panels and is foldable about a top wall fold line. Each top wall includes a wall section, a pair of top wall flaps, each top wall flap extending from one side of the wall section and foldable about by a top flap fold line, and a pair of bottom locking tabs, wherein each bottom locking tab extends from each of the pair of top wall flaps along a locking tab fold line and is insertable into a bottom tab slot of the bottom panel.

13 Claims, 21 Drawing Sheets

(56) References Cited

U.S. PATENT DOCUMENTS

| | | | | |
|---|---|---|---|---|
| 2005/0145687 | A1* | 7/2005 | Conway | B65D 5/0025 229/174 |
| 2008/0308439 | A1 | 12/2008 | Lidster et al. | |
| 2013/0026060 | A1* | 1/2013 | Moss | B65D 5/0035 206/512 |
| 2014/0054359 | A1 | 2/2014 | Benigni et al. | |
| 2015/0251797 | A1* | 9/2015 | Carman | B65D 5/0254 229/148 |
| 2016/0272362 | A1 | 9/2016 | Grajales et al. | |

* cited by examiner

STACKABLE PAPERBOARD CONTAINER

FIELD OF THE INVENTION

This invention relates to a stackable paperboard container and, more particularly, to a water-resistant stackable paperboard container for produce.

BACKGROUND

Produce, such as corn, tomatoes and apples, is transported from the site in which it is grown to locations for sale, display, or processing. Portable containers are known that are designed to suit the demands of a particular crop. Known containers may be heavy to transport if made of wood. Wooden or paperboard containers are susceptible to weakening if exposed to moisture and may become contaminated with microbes.

SUMMARY

A stackable paperboard container is provided and includes a bottom panel, a pair of side panels, a pair of end panels, a pair of side flaps, and a pair of top walls. The pair of side panels extend from the bottom panel and are foldable about a side panel fold line. The pair of end panels extend from the bottom panel and are foldable about an outer end fold line. Each side flap extends from one of a pair of side panels and is foldable about a side flap fold line. Each top wall extends from one of pair of end panels and is foldable about a top wall fold line. Each top wall includes a wall section, a pair of top wall flaps, each top wall flap extending from one side of the wall section and foldable about by a top flap fold line, and a pair of bottom locking tabs, wherein each bottom locking tab extends from each of the pair of top wall flaps along a locking tab fold line and is insertable into a bottom tab slot of the bottom panel.

BRIEF DESCRIPTION OF THE DRAWINGS

The invention will now be described by way of example with reference to the accompanying figures in which.

DETAILED DESCRIPTION OF THE EMBODIMENT(S)

Figure 1:
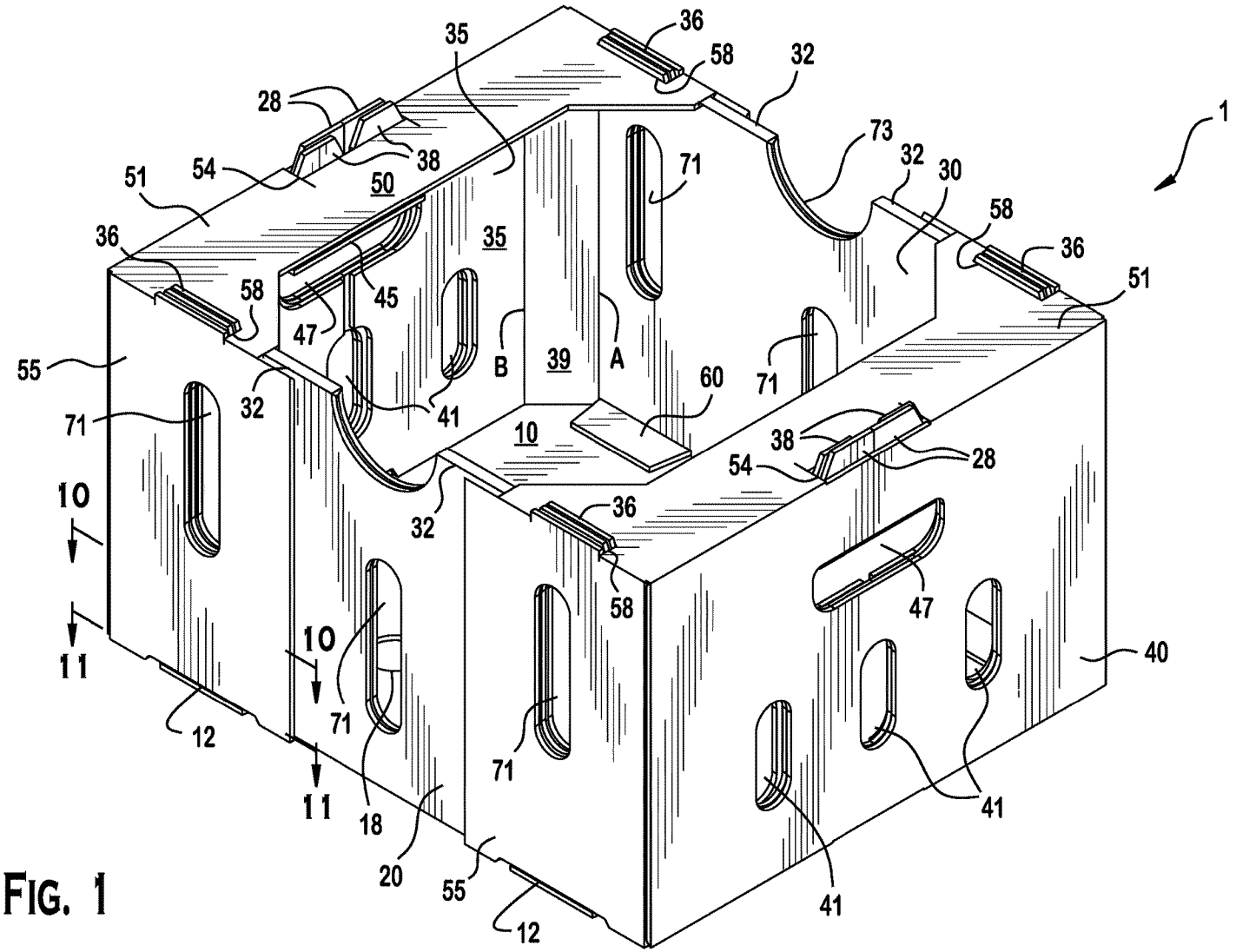
FIG. 1 is a top perspective view of a stackable paperboard container taken in accordance with an example of the current disclosure.
Figure 2:
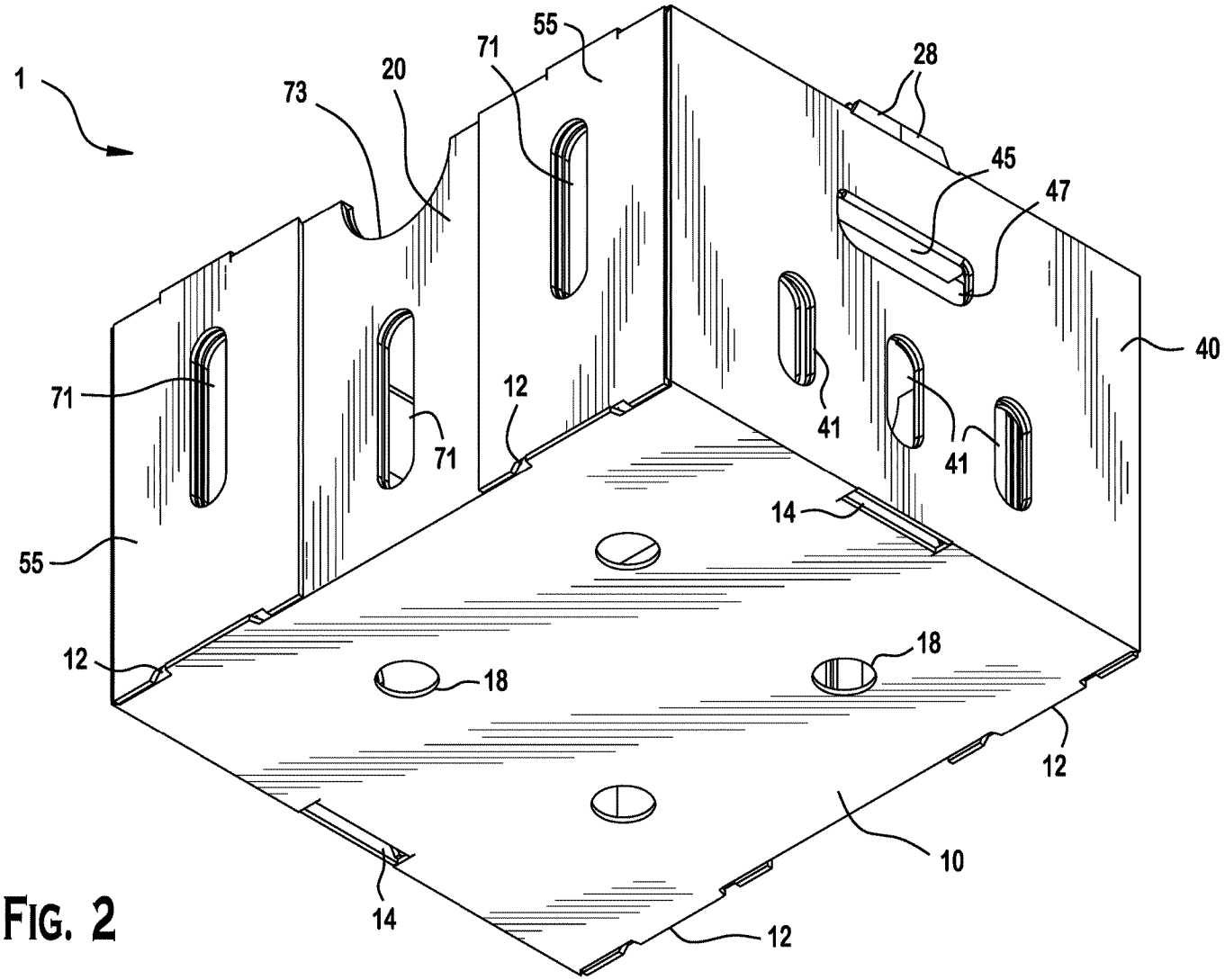
FIG. 2 is a bottom perspective view of a stackable paperboard container taken in accordance with an example of the current disclosure.
Figure 3:
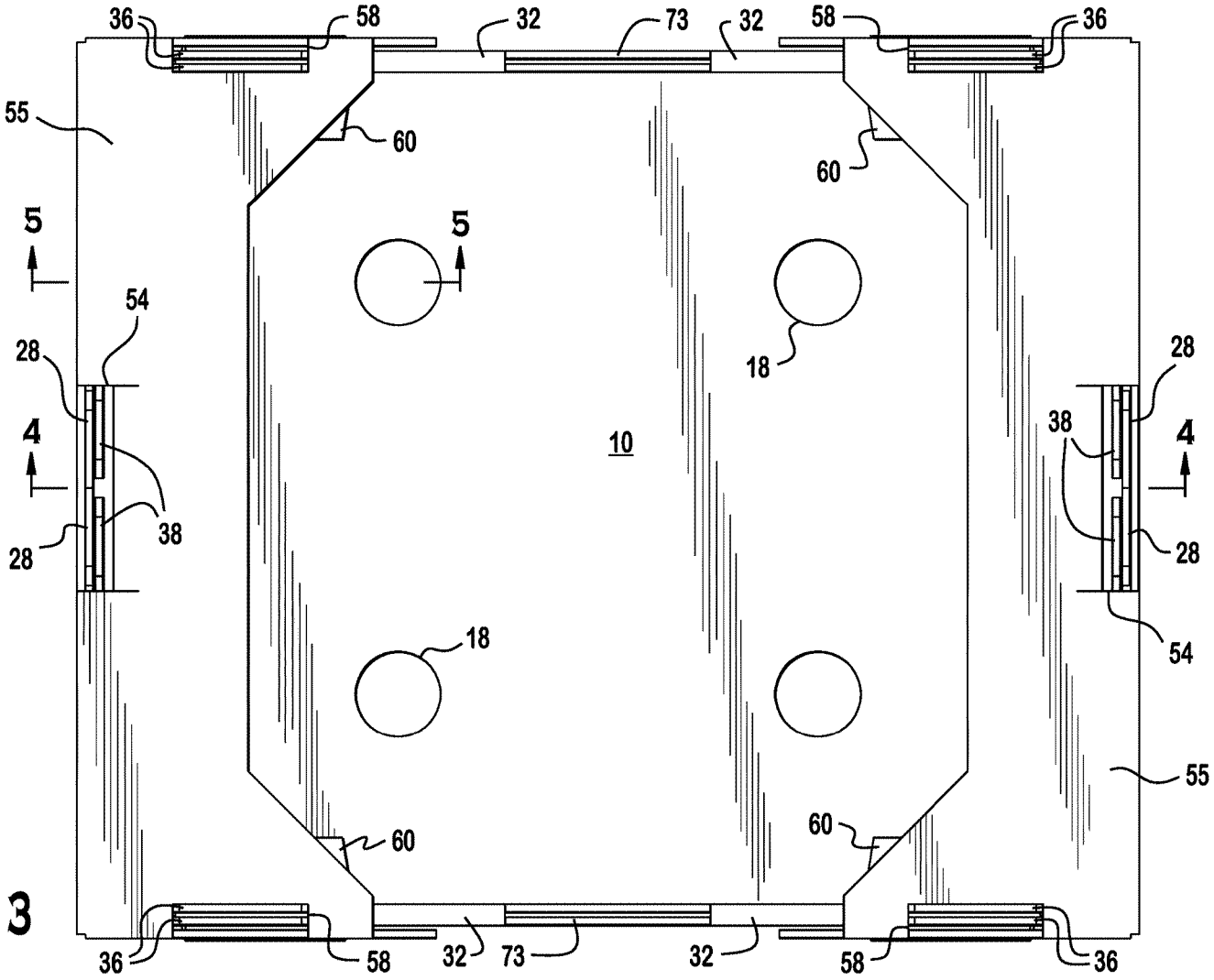
FIG. 3 is a top view of a stackable paperboard container taken in accordance with an example of the current disclosure.
Figure 4:
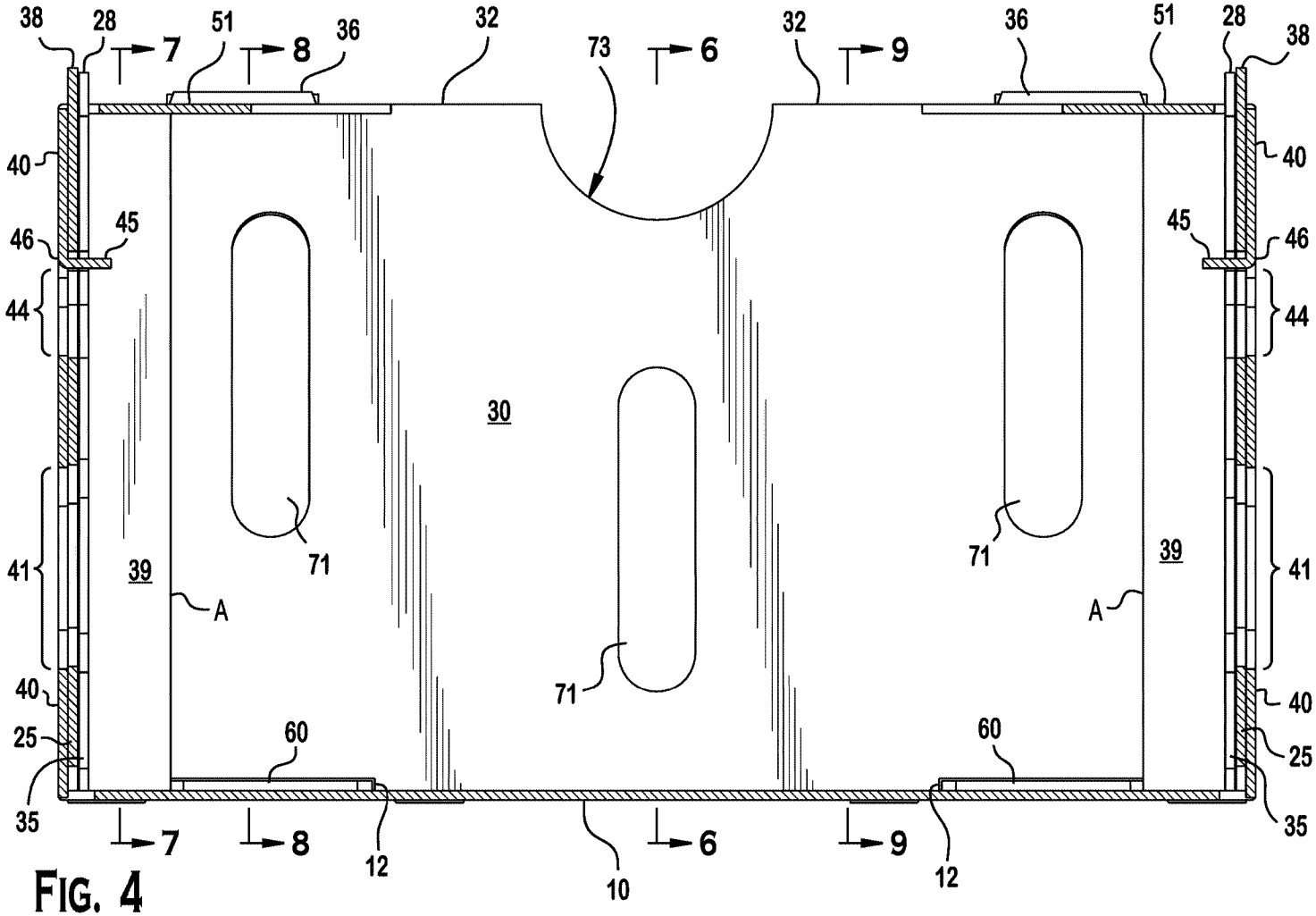
FIG. 4 is a cross-sectional view of the paperboard container taken along line 4-4 of FIG. 3 in accordance with an example of the current disclosure, showing the gripping flap positioned in the grip.
Figure 5:
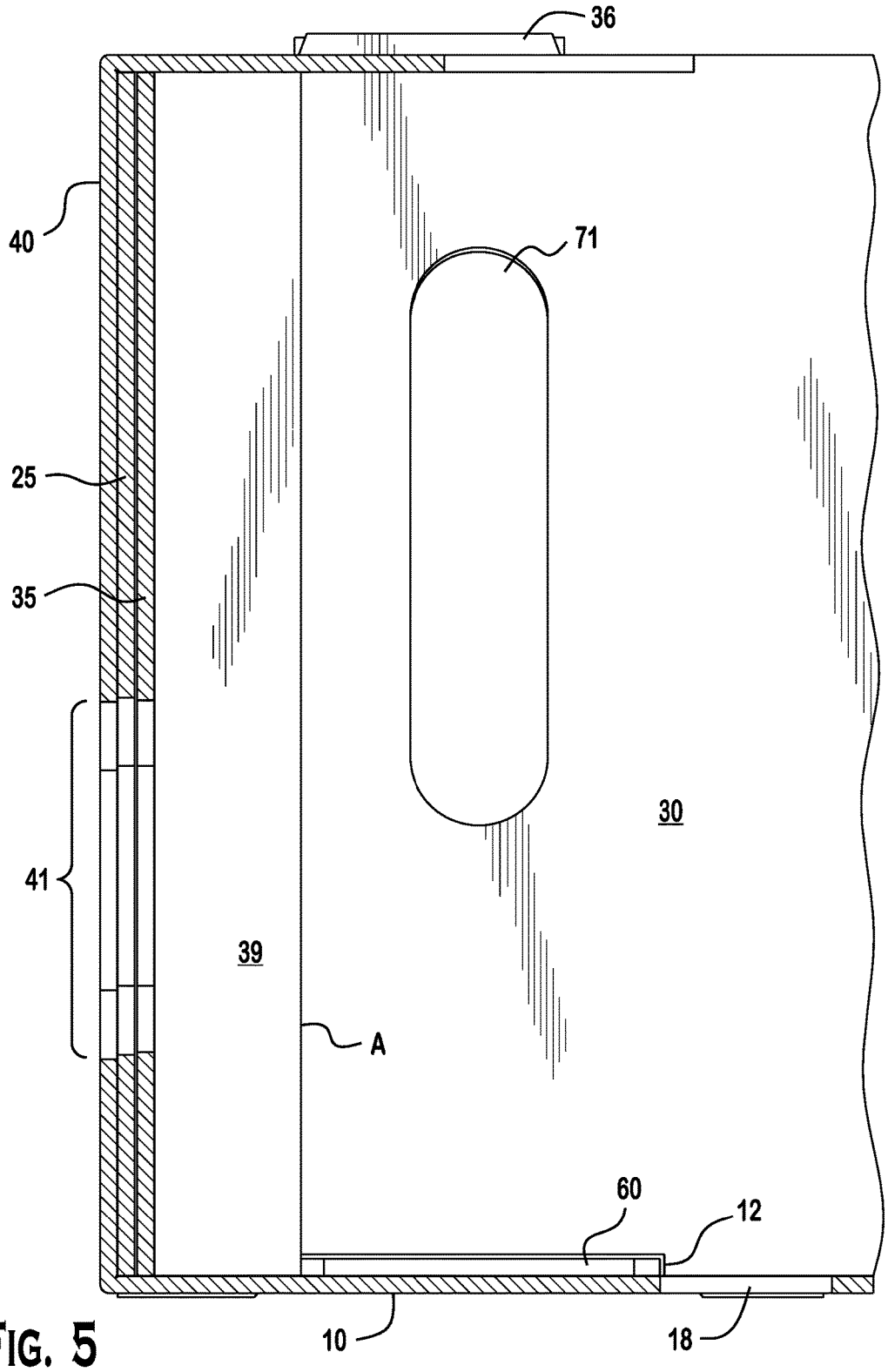
FIG. 5 is a partial cross-sectional view of the paperboard container taken along line 5-5 of FIG. 3 in accordance with an example of the current disclosure, showing a corner support structure and shoulder tabs aligned in shoulder locking slots.
Figure 6:
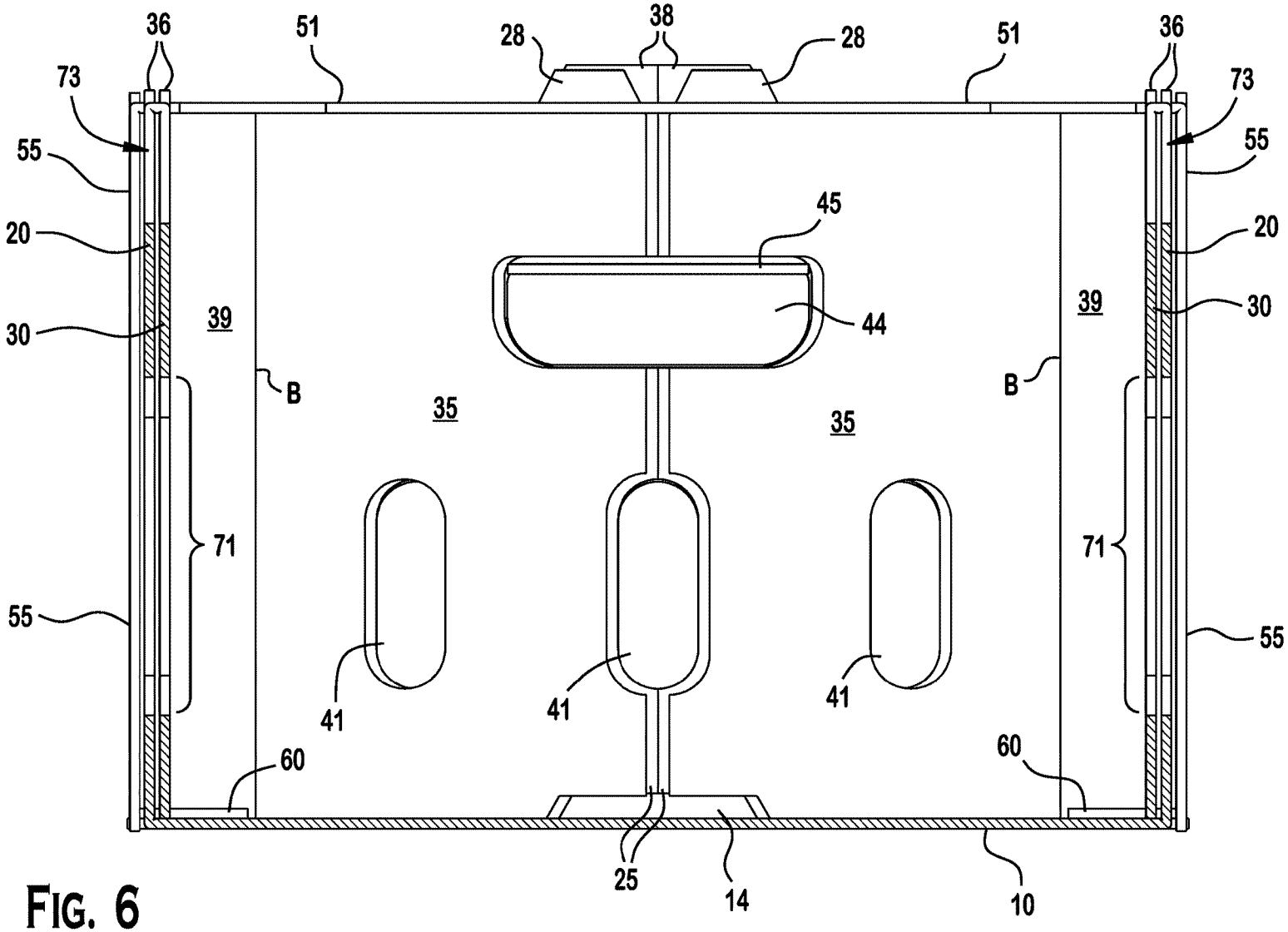
FIG. 6 is a cross-sectional view of the paperboard container taken along line 6-6 of FIG. 4 in accordance with an example of the current disclosure, showing a corner support wall, three layers of paperboard, aligned vents, and a gripping flap positioned along a grip.
Figure 7:
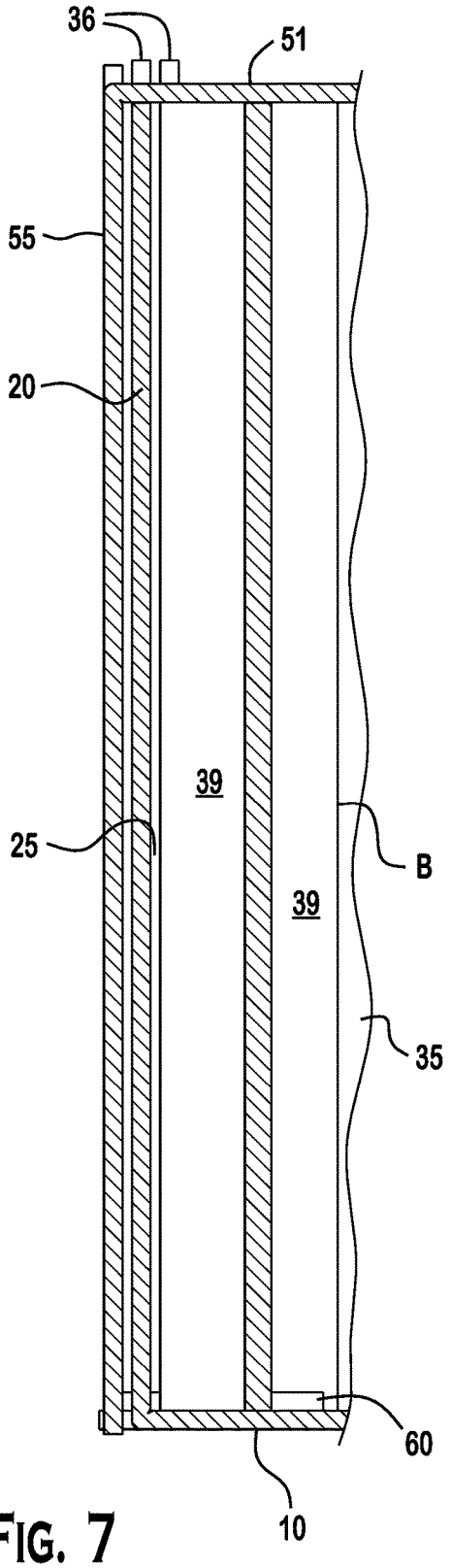
FIG. 7 is a partial cross-sectional view of the paperboard container taken along line 7-7 of FIG. 4 in accordance with an example of the current disclosure, showing the three layers of paperboard.
Figure 8:
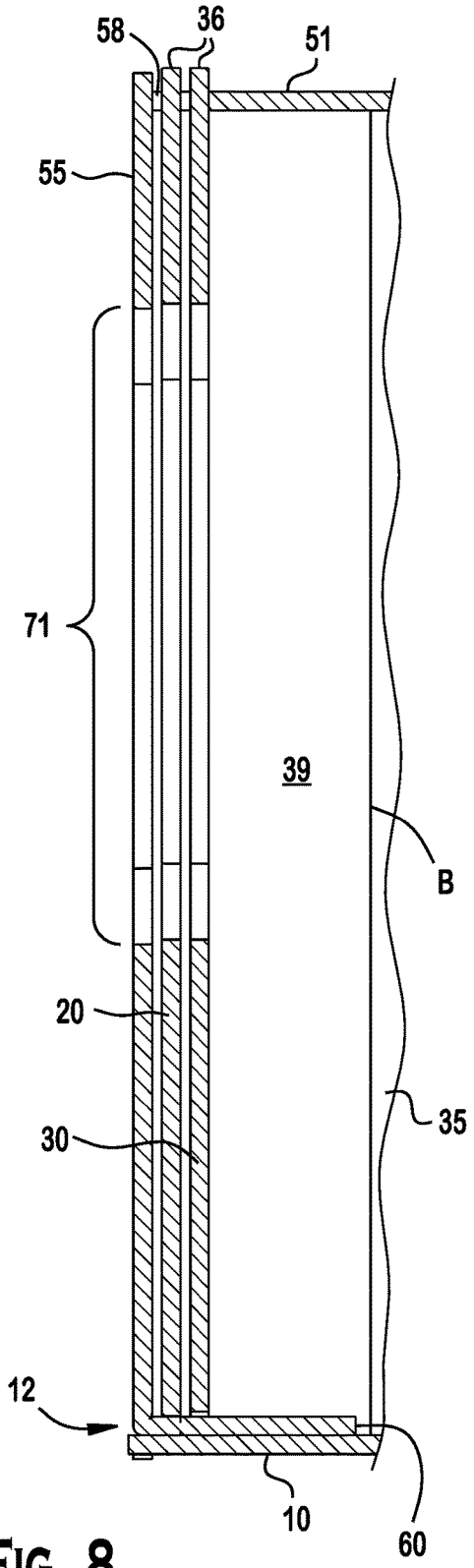
FIG. 8 is a partial cross-sectional view of the paperboard container taken along line 8-8 of FIG. 4 of FIG. 4 in accordance with an example of the current disclosure, showing the three layers of paperboard and aligned vents.
Figure 9:
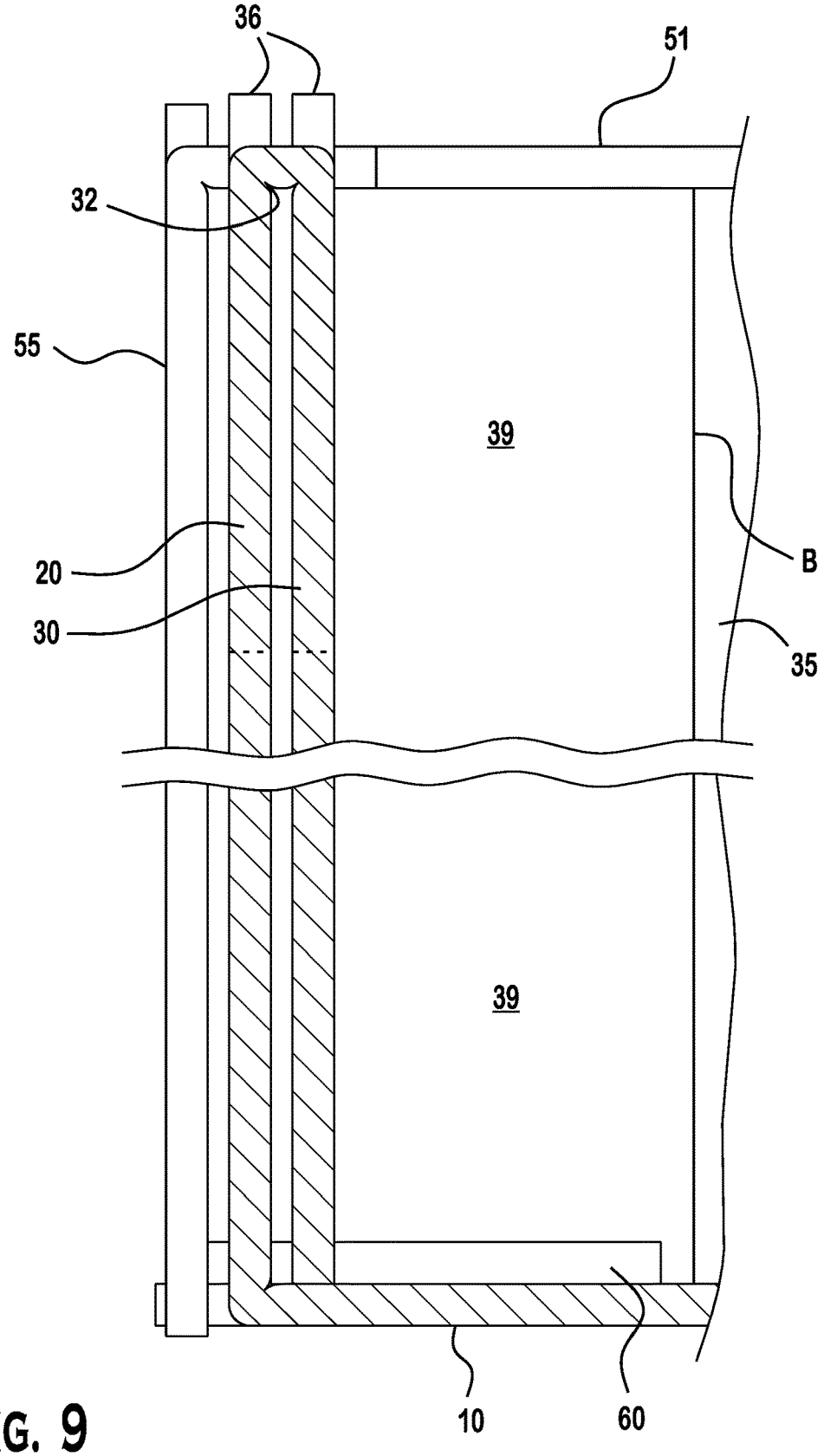
FIG. 9 a partial cross-sectional view of the paperboard container taken along line 9-9 in accordance with an example of the current disclosure, showing the three layers of paperboard.
Figure 11:
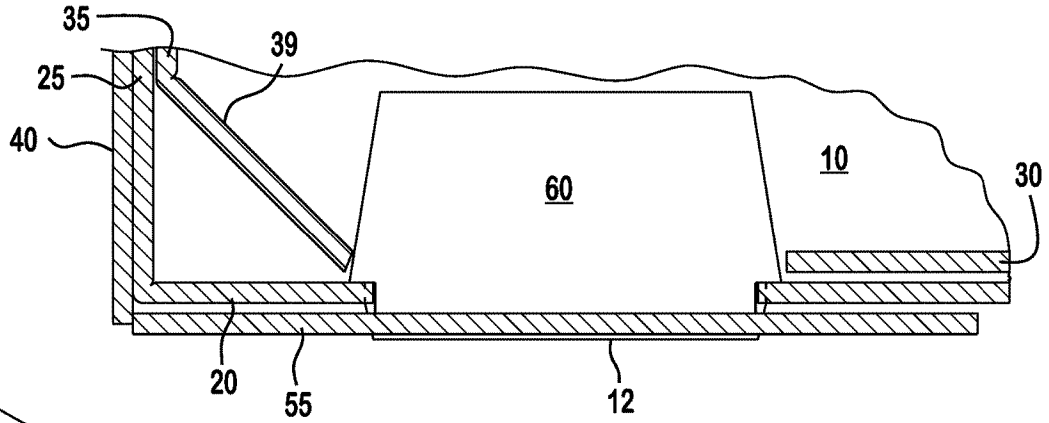
FIG. 11 is a partial cross-sectional view of the paperboard container taken along line 11-11 of FIG. 1 in accordance with an example of the current disclosure, showing the fold line at a juncture of the bottom panel and the side panel, the corner support wall, and the bottom tab extended through bottom tab slot at the fold line.
Figure 10:
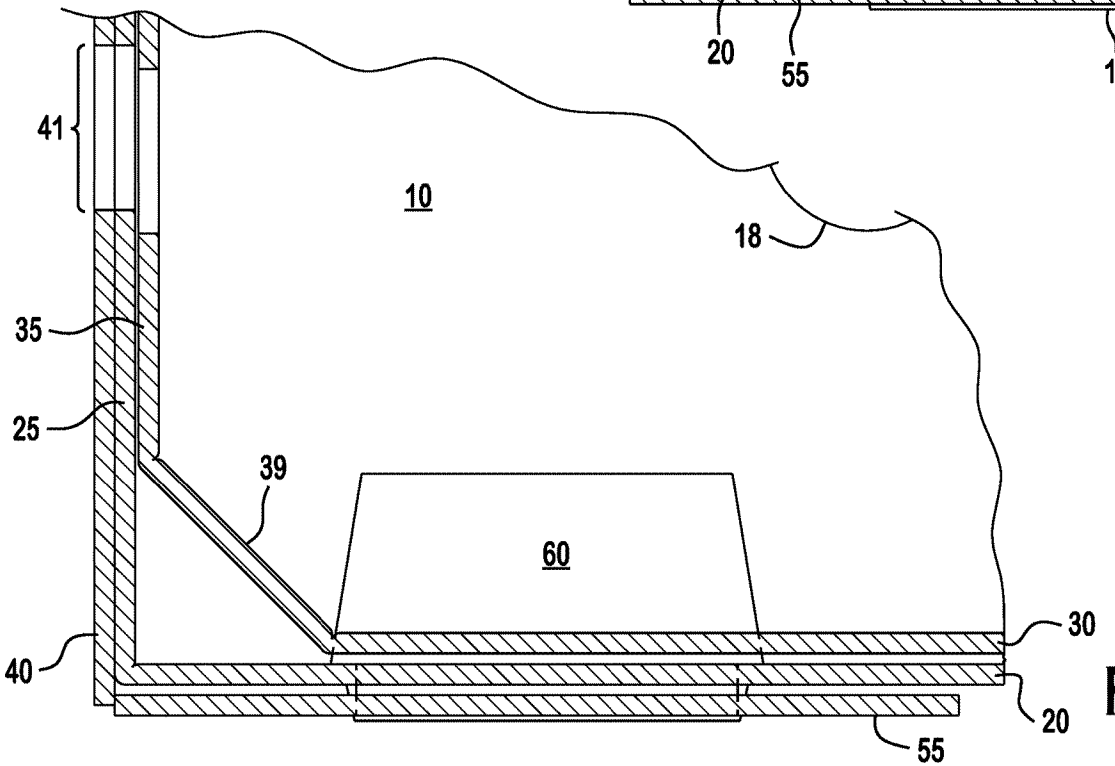
FIG. 10 is a partial cross-sectional view of the paperboard container taken along line 10-10 of FIG. 1 in accordance with an example of the current disclosure, showing the three layers of paperboard, the corner support wall 39, and a bottom tab extended through a bottom tab slot along the side panel fold line 22.

Referring more particularly to the FIGS. 1-23 in which like numbers refer to similar parts, a stackable, corrugated paperboard container 1 of this invention is shown. The paperboard container 1 generally includes a triangular support 39 in each corner formed of hingedly attached side panels 20 and side flaps 30, a top wall 50 to at least partially shield the container contents, and top wall flaps 55 having locking tabs 60 to secure the assembled container 1, as shown.

Figure 21:
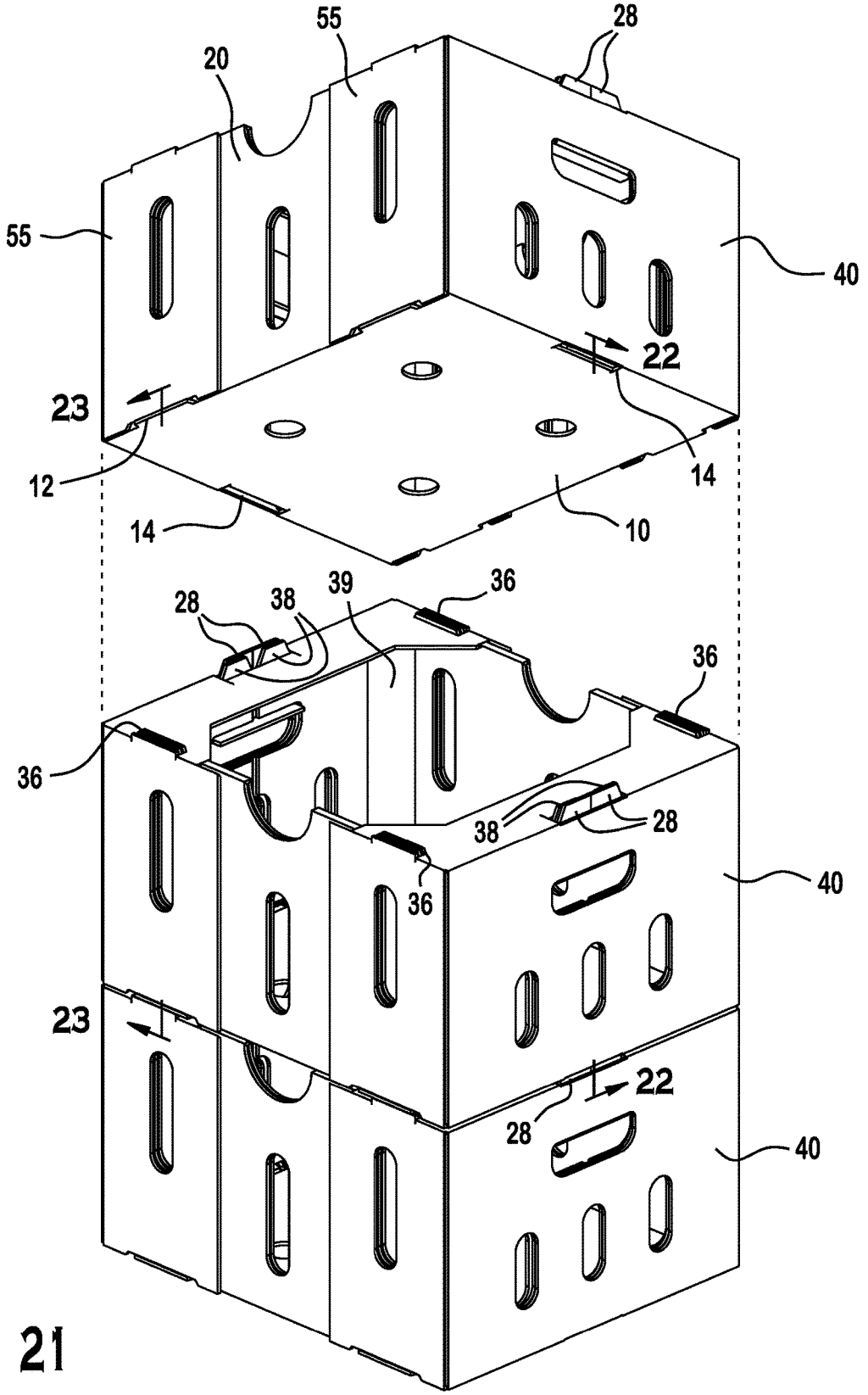
FIG. 21 is a side perspective view of multiple stackable paperboard containers arranged on top of each other, the view showing interlocking tabs and slots that allow the paperboard containers to be stacked.
Figure 22:
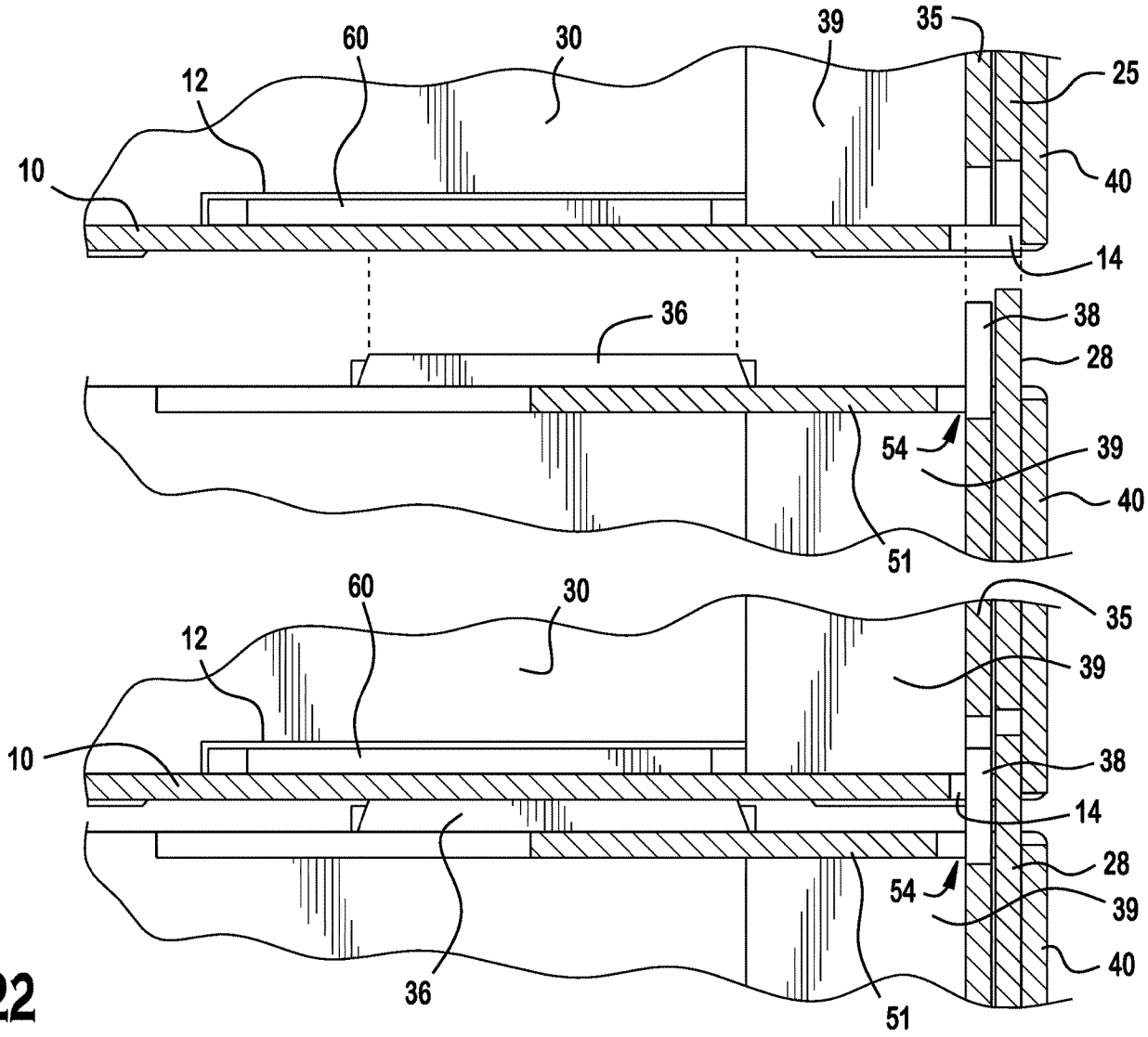
FIG. 22 is a partial cross-sectional view of multiple stackable paperboard containers taken along line 22-22 of FIG. 21 showing how immediately adjacent containers may be stacked by aligning the bottom receiving passageway and the stacking tabs.
Figure 23:
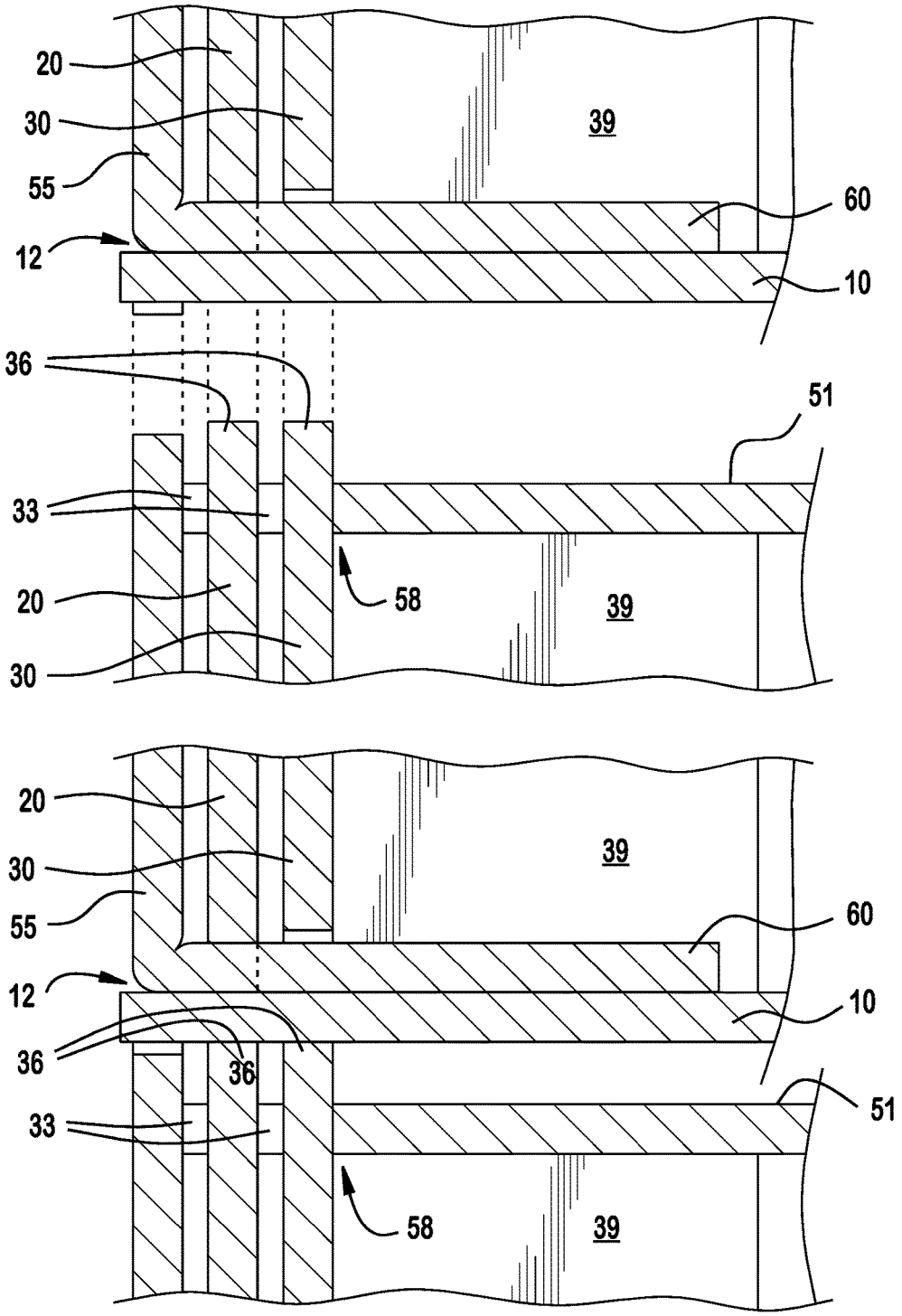
FIG. 23 is a partial cross-sectional view of multiple stackable paperboard containers taken along line 23-23 of FIG. 21 showing how immediately adjacent containers may be stacked by aligning the shoulder locking slot and the shoulder tabs.

Figures land 2 show the paperboard container 1 assembled for use. FIG. 21 shows multiple containers stacked in accordance with the features of the invention.

Figure 12:
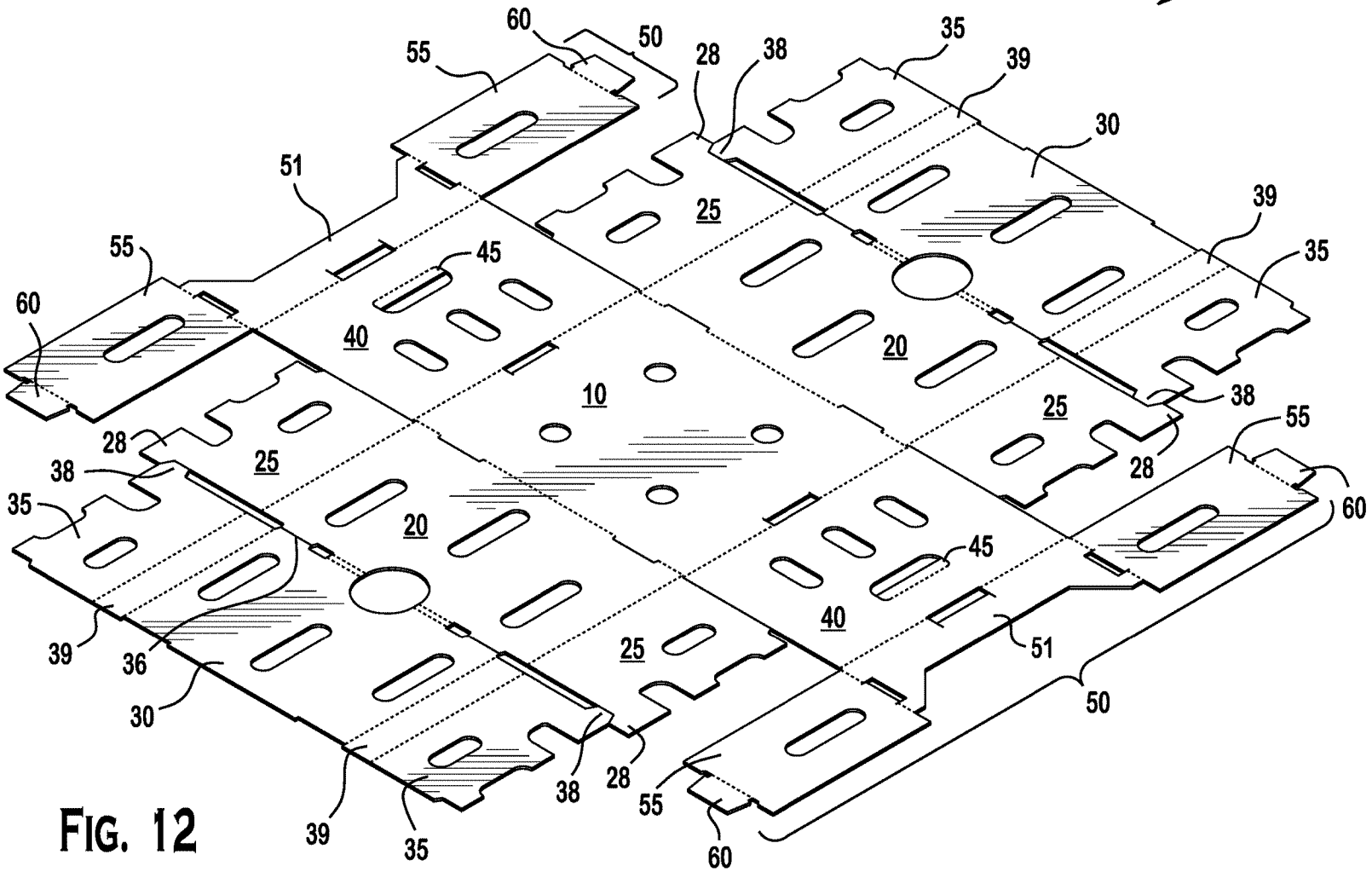
FIG. 12 is a perspective top view of an unassembled container blank of a stackable paperboard container in accordance with an example of the current disclosure showing the solid elements of the blank.
Figure 13:
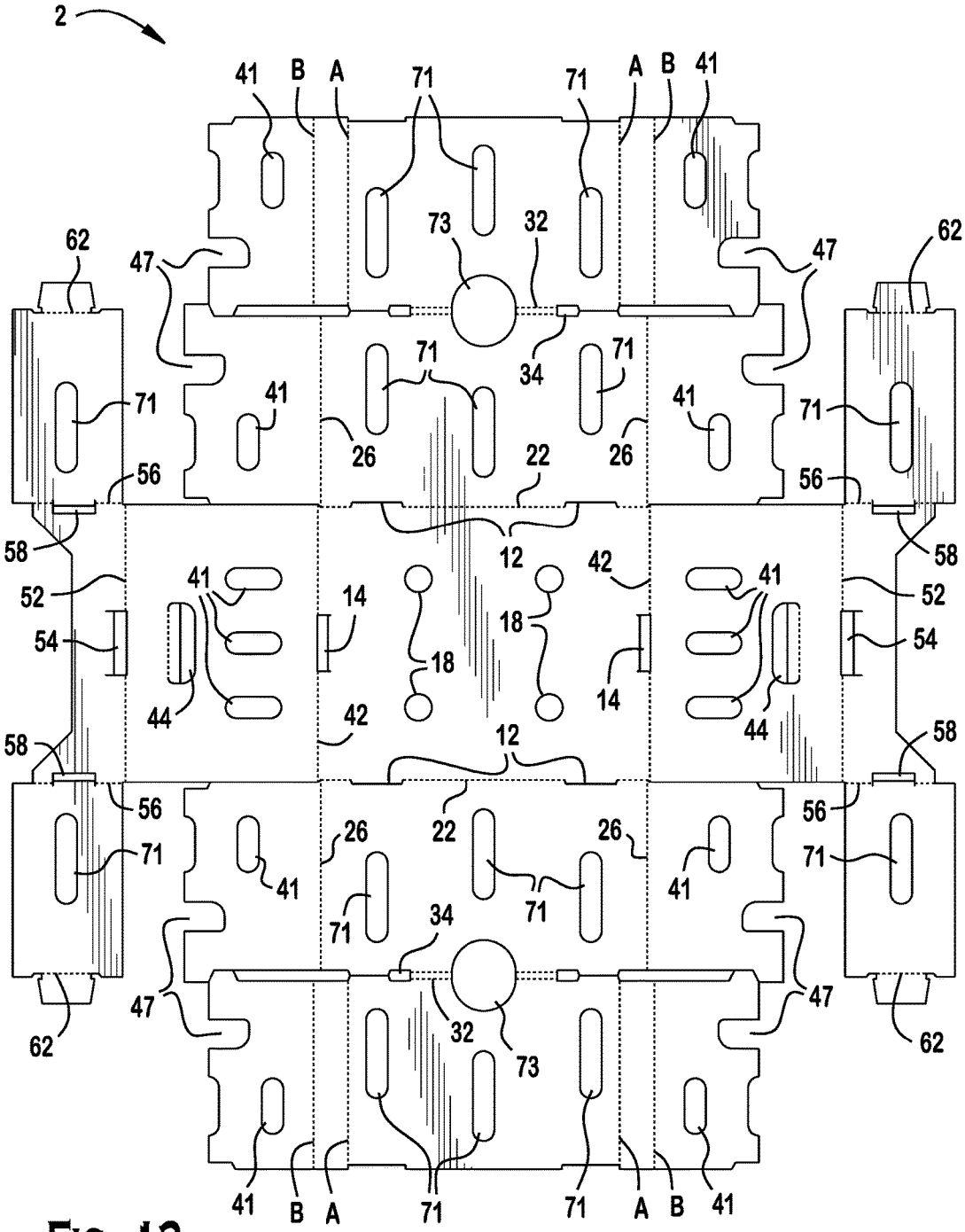
FIG. 13 is a plan top view of the unassembled container blank of FIG. 12 showing the fold lines and voids of the blank 4.

FIGS. 12 and 13 show an unassembled container blank 2 which, when assembled using the indicated fold lines, forms the stackable paperboard container 1. The blank 2 is a single thickness of corrugated paperboard, having, as desirable, one, two, or more plies of corrugations, a choice that depends on the strength required of the assembled container. One of skill in the art of paperboard containers will recognize that alternative types of materials used to make containers, such as plastic, coated fiberboard, and cardboard, may also be used to form the blank 2. When corrugated paperboard is used it is preferred that the corrugations are positioned to run perpendicular to the fold line between a side panel and the bottom.

The blank 2 is die-cut and folded to minimize waste and unutilized areas of corrugated paperboard. In a first embodiment of the invention, the blank 2 is cut to outside dimensions of 49 3/16"×44". Unless otherwise indicated, other dimensions given herein will be with regard to the first embodiment of the invention.

The assembled container 1 is generally rectangular. Therefore, the blank 2 has a rectangular bottom panel 10 as shown in FIGS. 1-3, and 12-21. The blank 2 is symmetrical with regard to a central longitudinal line and is also symmetrical to a central horizontal line, these lines (not shown) intersecting perpendicularly at the center of bottom panel 10. In this description, one of ordinary skill in the art will understand that elements with like numbers reflect that symmetry. The term "inner" refers to elements or surfaces more proximate to this intersection and the term "outer" refers to elements or surfaces more distal to this intersection of central longitudinal and central horizontal lines. The term "middle" refers to an element or surface positioned between an inner and outer element or surface in the assembled container.

In a first embodiment of the paperboard container 1, the dimensions of the bottom panel 10 are 15½"×12¾". The side panels and end panels, as described in greater detail below, complete the assembled container 1, as shown particularly in FIGS. 1-2, 4-6, and 14-21.

The bottom panel 10 has a side panel 20 extending along a side panel fold line 22 on one longer side of the bottom panel 10 and a second side panel 20 extending along a side panel fold line 22*b* on the opposing longer side of the bottom panel 10. Two base cuts 24 are located within each side panel fold line 22. When container 1 is assembled, the base cuts 24 form a bottom slot 12 to receive a locking tab 60 described below. When assembled, the paperboard container 1 has a vertical height determined by the height of the side panel 20, i.e., of 9" in a first embodiment.

A outer support panel 25 extends along a middle panel fold line 26 from each short length of the side panel 20. The middle panel fold line 26 extends from each corner of the bottom panel 10 toward the outer edge of each side panel 20. A stacking tab 28 is located on the outer support panel 25 that, when the container 1 is assembled, will be received into a tab receiving passageway 54 as described below.

A side flap 30 extends from each side panel 20 along a side flap fold line 32 and opposite the bottom panel 10. Within the side flap fold line 32, formed of two parallel scored lines, is situated on the blank 2 generally centrally an air receiving passageway, hereinafter referred to as a aperture 73.

Between the outer ends of the side flap fold line 32 and fold line A is a slot 34, the cutting of which forms a shoulder tab 36. When the paperboard container 1 is assembled, the side flap 30 is folded at the side flap fold line 32 to pivot 180 degrees and is positioned against the inner surface of the side panel 20. Upon this action, the aperture 73 now forms a half circle on the container wall and the shoulder tabs 36, on either side of the aperture 33, will be received into a shoulder locking slot 58, as described below.

Each side flap 30 is scored at fold line A and fold line B to form corner support 39. An inner end panel 35 extends from each side flap 30 at fold line B. A stacking tab 38, located on the inner end panel 35, will be received into a tab receiving passageway 54 as described below when the paperboard container 1 is assembled A outer support panel 25 extends from each side panel 20 along the middle panel fold line 26. A stacking tab 28, located on outer support panel 25, will be received into a tab receiving passageway 54 as described below when the paperboard container 1 is assembled.

The blank 2 has an outer end panel 40 extending along an outer end fold line 42 at each short side of the bottom panel 10. Each outer end panel 40 has a grip 44. A hand flap 45 extends from each outer end panel 40 along a hand flap fold line 46.

A top wall 50 extends from each of the pair of outer end panel 40 along a top wall fold line 52. Each top wall 50 is comprised of a top wall section 51 from which a pair of top wall flaps 55 extend from along a pair of top flap fold lines 56. A shoulder lock slot 58 is located in the top wall section 51 adjacent to the top wall flap 55 and along top flap fold line 56. Upon assembly, the shoulder lock slot 58 will receive shoulder tabs 36 located on each side panel 20 and each side flap 30. In top wall section 51 adjacent to the top wall fold line 52 is a tab receiving passageway 54 to receive stacking tabs 28 and 38 located respectively on each outer support panel 25 and each inner end panel 35 as described above. The top wall section 51 is indented at its midpoint width and expanded at its juncture at the top flap fold line to accommodate the shoulder slot 58.

A bottom locking tab 60 extends from each top wall flap 55 along a locking tab fold line 62. The bottom locking tab 60 will be received into the bottom locking slot 12 described above.

Ventilation passageways 70 (herein after referred to collectively as "vents" 70) are situated within panels 10, 20, 25, 30, 35, 40, and 55 in a shape and as located by one of ordinary skill in the art to affect air flow and humidity. The vents 70 are positioned on each panel so that, when the paperboard container 1 is assembled, the vents on adjacent panels, if any, are aligned. Aligned vents are of like shape. In the first embodiment long vents 71 are shown in FIGS. 1-2, 4-5, and 12-21. In the first embodiment, short vents 41 are shown in FIGS. 1-2, 6, and 12-21. In the first embodiment, the aperture 73 is shown in FIGS. 1-2, 4, and 13-21. In the first embodiment, grip vents 47 are shown in FIGS.

1-2, 6, and 12-21. In the first embodiment, bottom vents 18 are shown in FIGS. 1-3 and 12-21.

Figure 14:
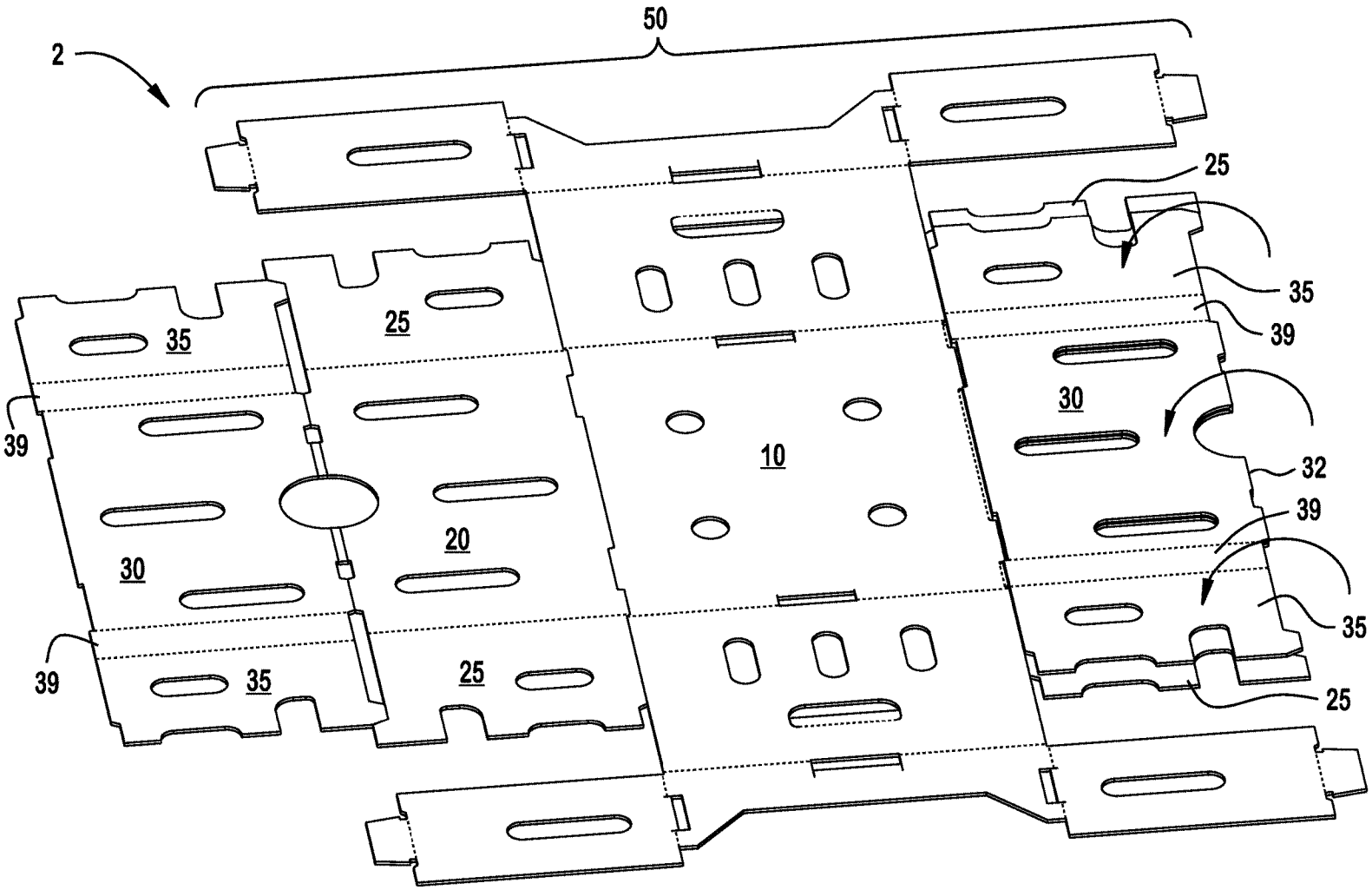
FIG. 14 is a top perspective view of the unassembled container blank of FIG. 12.

Now referring particularly to FIGS. 14-20, assembly of the stackable paperboard container 1 will be described. As shown in FIG. 14, each side flap 30 on either side of bottom panel 10 is folded at the side flap fold line 32 and brought about 180 degrees to lie on the inner surface of the side panel 20. This creates opposing double layered sidewalls. It also aligns the long vents 71 of the side panels 20 and of the side flaps 30.

Figure 15:
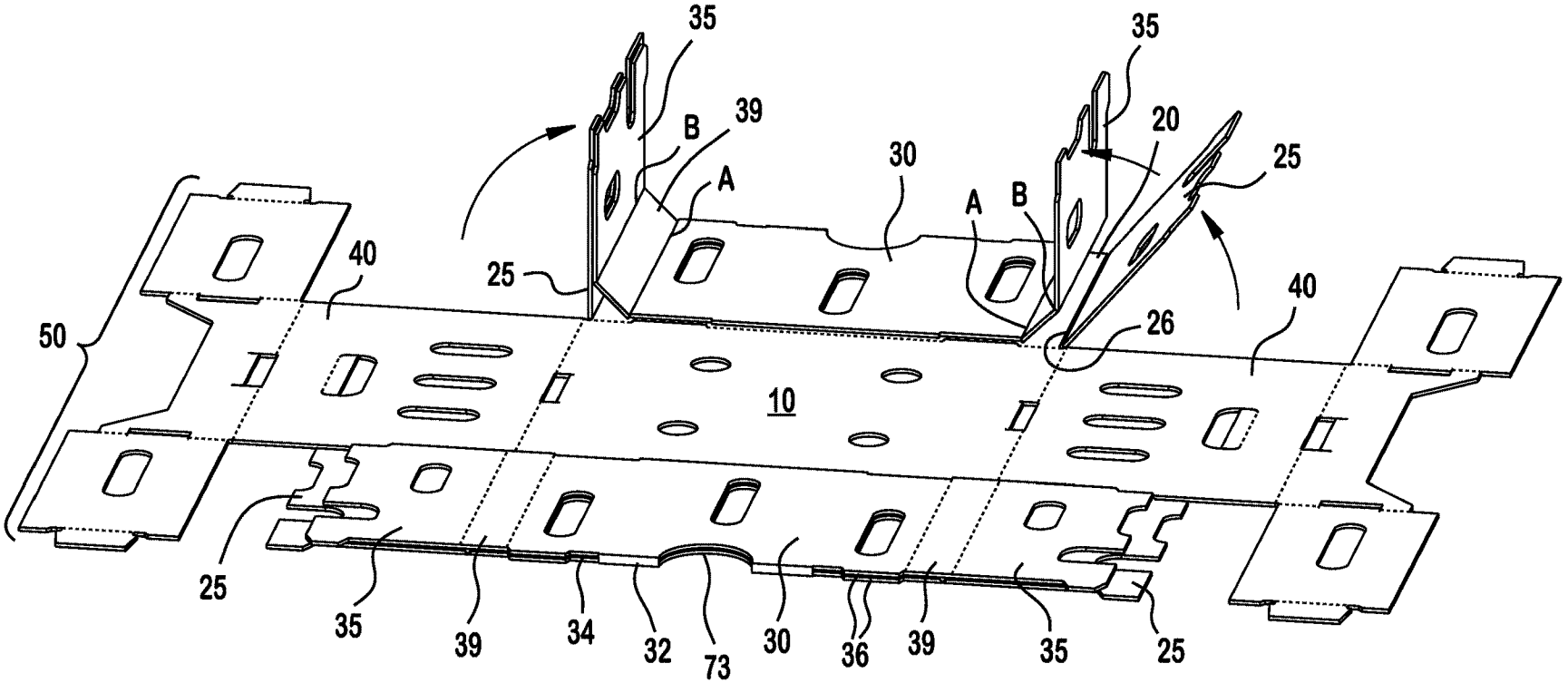
FIG. 15 is a top and side perspective view of the unassembled container blank of FIG. 12 showing first assembly steps.

As shown in FIG. 15, each outer support panel 25 is folded at the middle panel fold line 26 at a 90° angle. Each inner end panel 35 is folded about fold lines A and B to create the corner support 39 to run diagonally at the juncture of the outer support panel 25 and the inner end panel 35.

Figure 16:
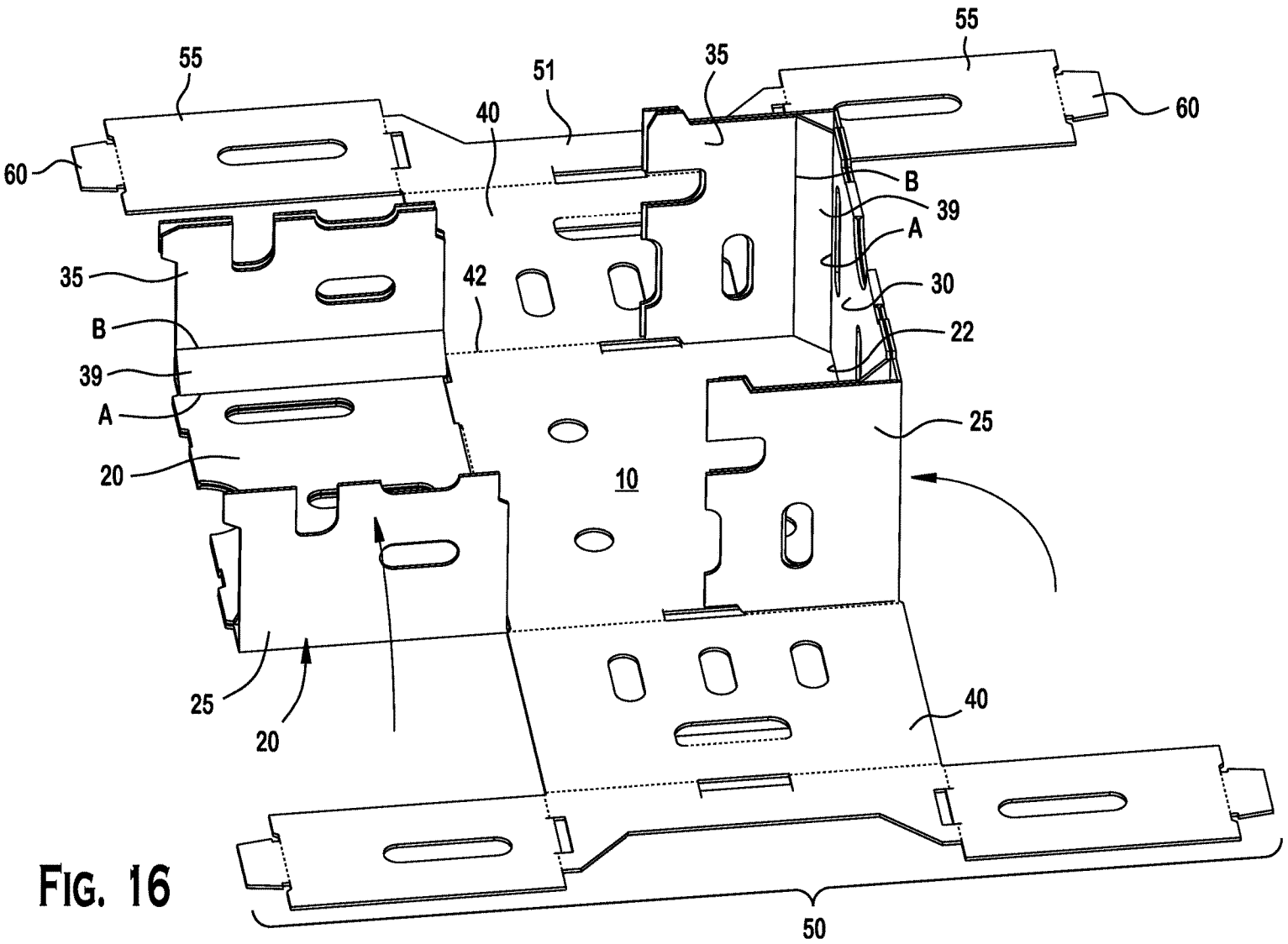
FIG. 16 is a top and side perspective view of the unassembled container blank of FIG. 12 show subsequent assembly steps.

As further shown in FIG. 16, fold each side panel at the side panel fold line 22 so that the bottom panel 10 and each side panel 20 are at a 90° angle to each other at their juncture.

Figure 17:
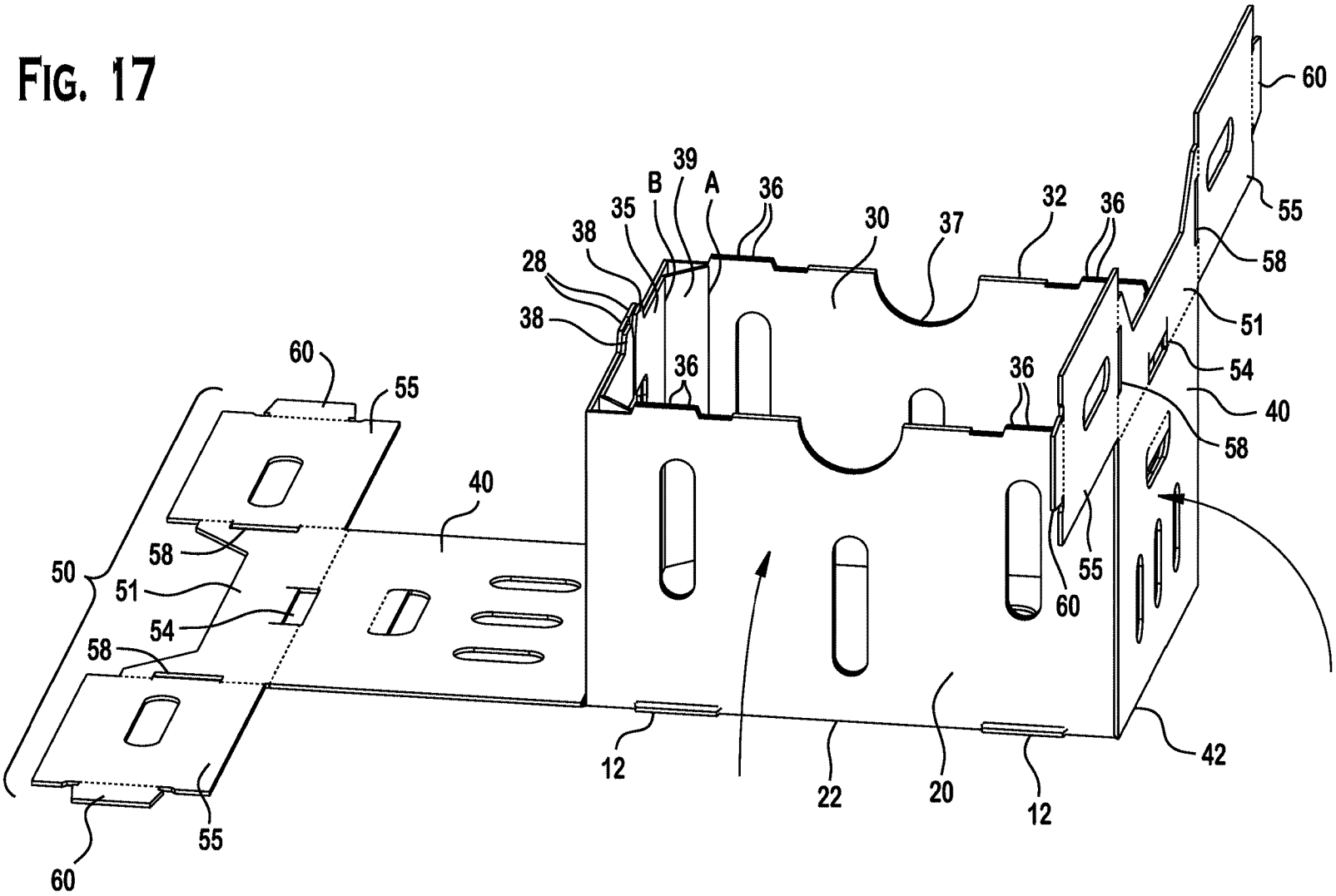
FIG. 17 is a top and side perspective view of the unassembled container blank of FIG. 12 showing further assembly steps.

As shown in FIG. 17, fold each end panel 40 at the outer end fold line 42 so that the bottom panel 10 and each end panel 40 are at a 90° angle relative to each other at their juncture. Arrange the outer support panels 25 and inner end panels 35 to rest along the outer end fold line 42, an action that positions the corner support 39 in place at each of the four corners. This action creates opposing triple layered end walls. It also aligns the grip 44 of the outer end panel 40 with the grip vents 47 of the outer support panel 25 and the outer end panel 35 and aligns the short vents 41 in the outer end panel 40, outer support panel 25, and the inner end panel 35.

Figure 18:
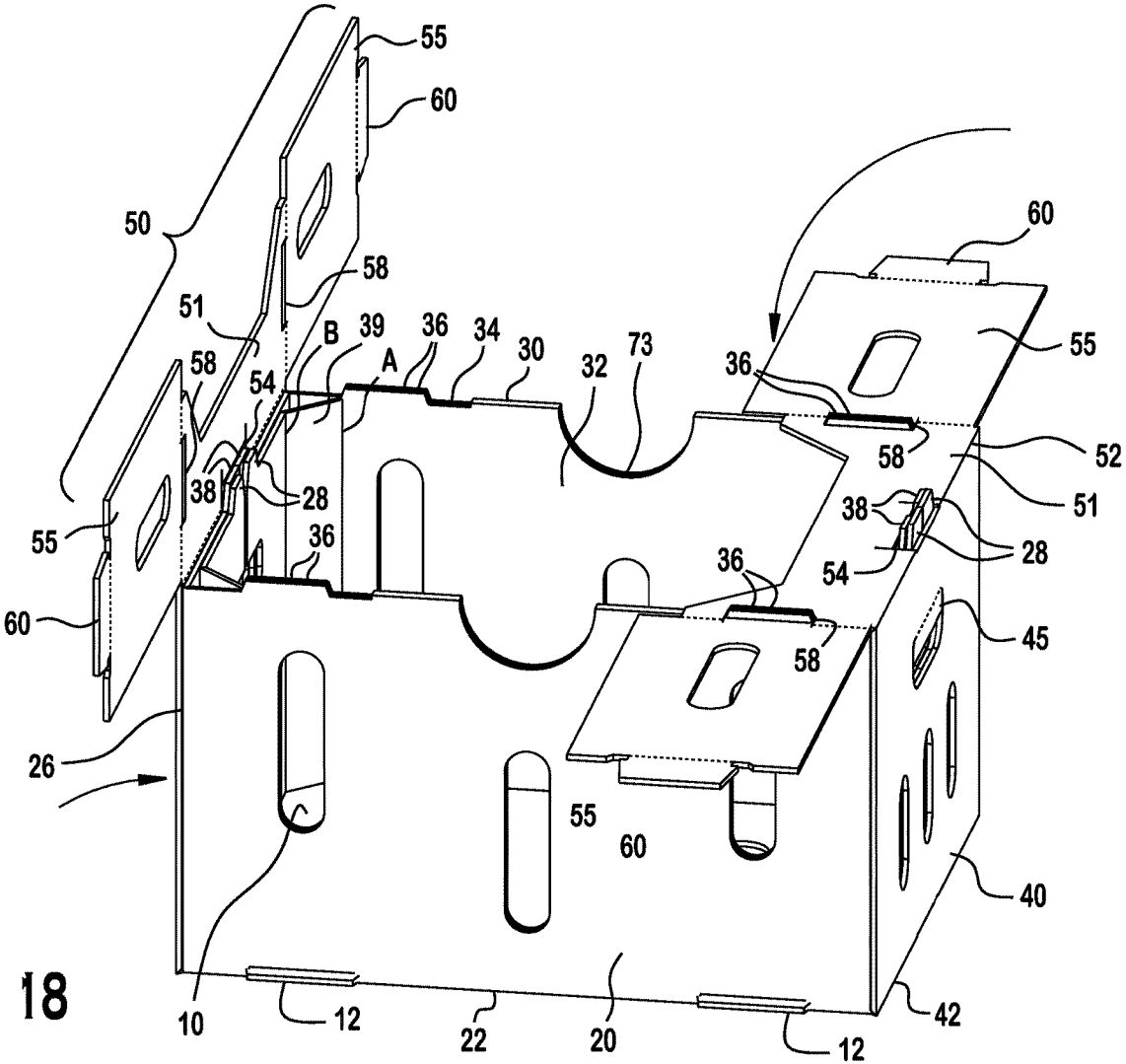
FIG. 18 is a top and side perspective view of the unassembled container blank of FIG. 12 showing further assembly steps.
Figure 19:
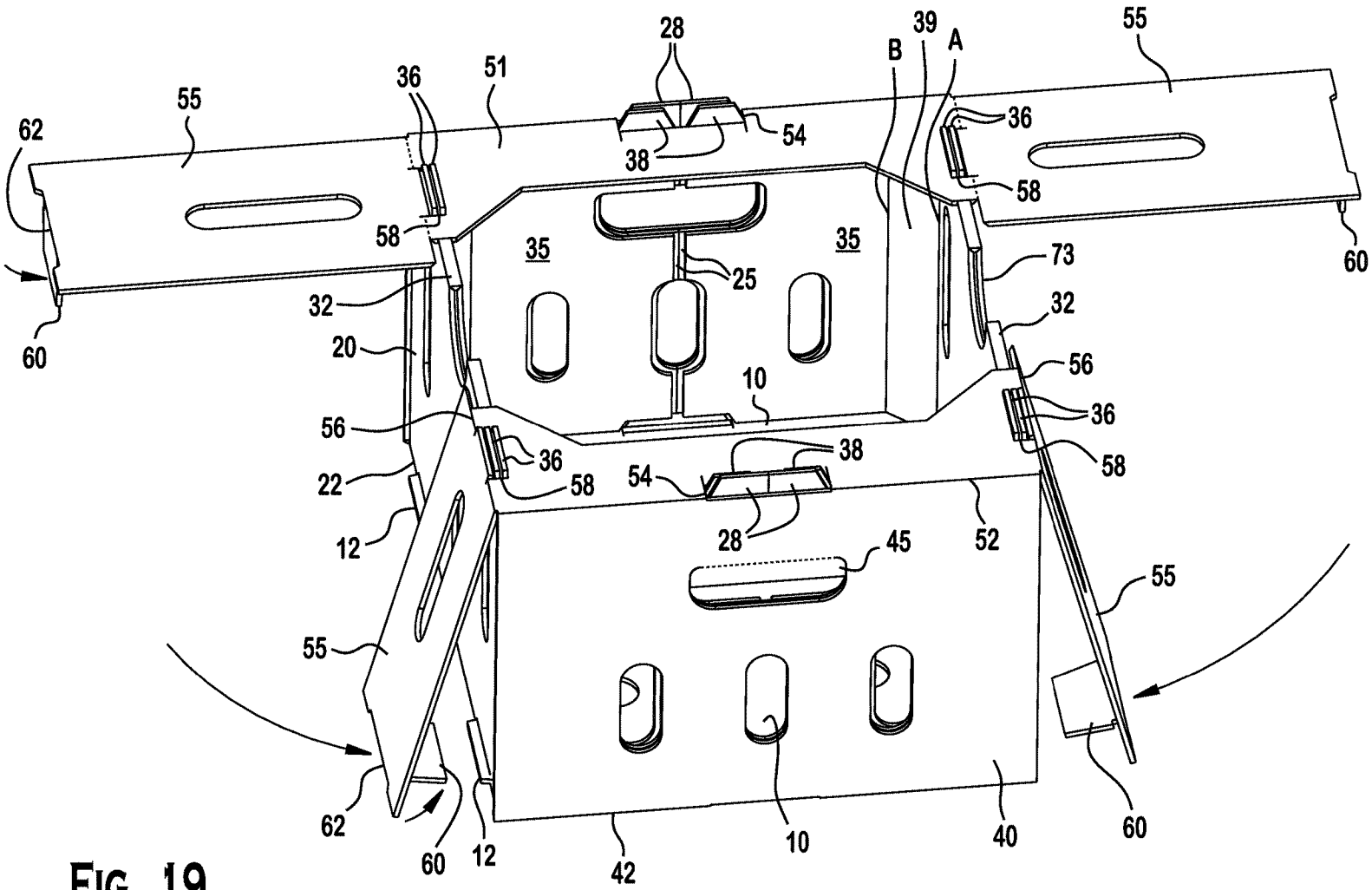
FIG. 19 is a top and side perspective view of the unassembled container blank of FIG. 12 showing further assembly steps.
Figure 20:
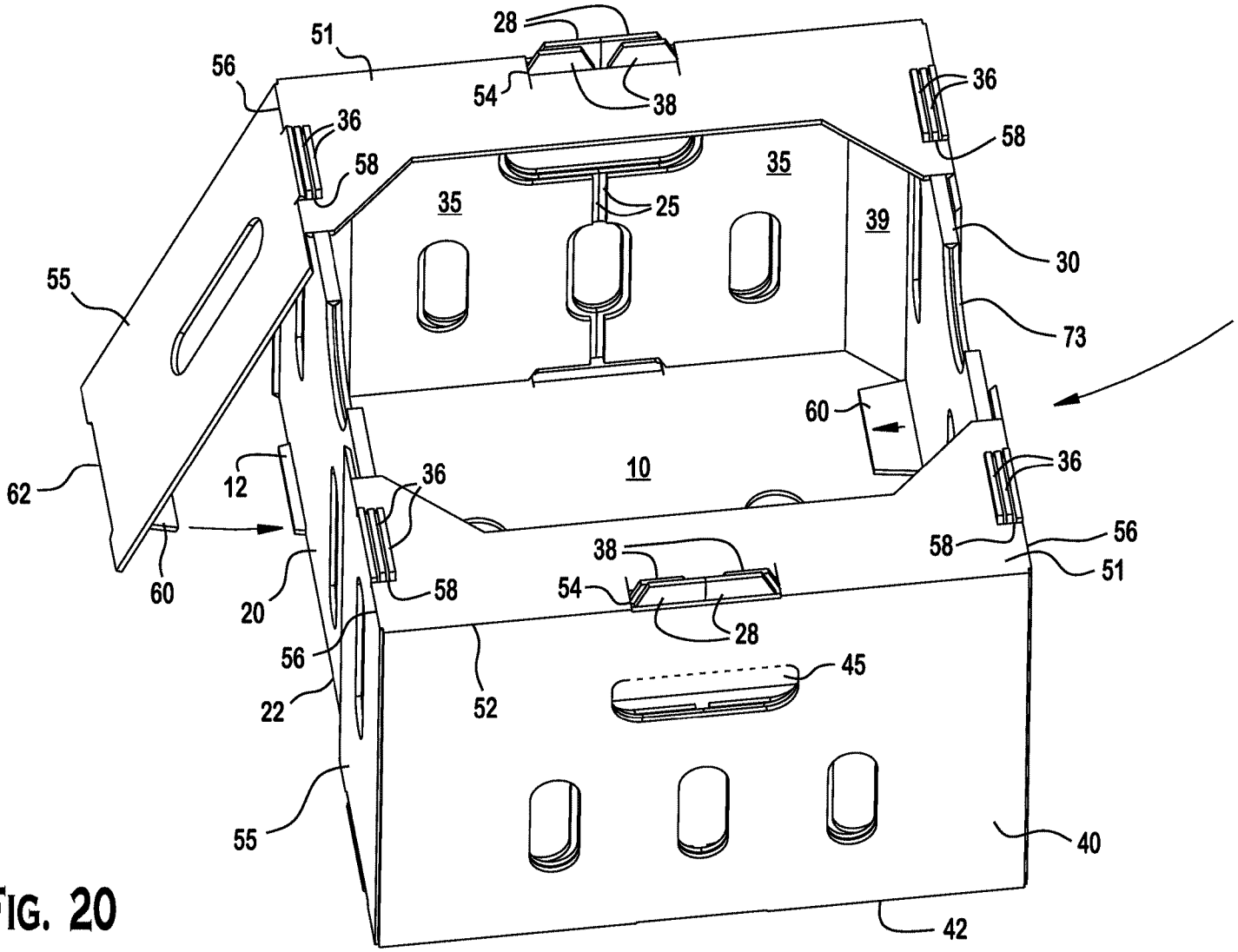
FIG. 20 is a side perspective view showing the fully assembled container from the unassembled container blank of FIG. 12.

As shown in FIGS. 17 and 18, fold the top wall 50 toward the opposite end of the paperboard container 1 at a 90° angle at top wall fold line 52. Arrange stacking tab 28 (on the outer support panel 25) and stacking tab 38 (on the inner end panel 35) to be received through the tab receiving passageway 54 of top wall 51. As shown in FIGS. 18 and 19, arrange shoulder tabs 37 to be received in shoulder locking slot 58.

As shown in FIGS. 18 and 19, fold the top wall flap 55 toward the bottom panel 10 along top flap fold line 56 at a 90° angle so that the top wall flap 55 lies against the outer surface of the side panel 20. This action forms a triple layer wall. Fold the bottom tab 60 along the locking tab fold line 62 a 90° angle relative to the top wall flap 55 and insert the bottom tab 60 into bottom slot 12. This action secures the container 1 in an assembled form.

As shown in FIG. 21, the fully assembled container 1 can be stacked by aligning (1) the stacking tabs 28 and 38 of a lower container 1 with the bottom receiving passageway 14 of an immediately adjacent upper container 1, and (2) the shoulder tabs 37 of a lower container 1 with the shoulder locking slots 58 of an immediately adjacent upper container 1.

The folding of fold lines A and B on inner end panel 35 and side flap 30 in conjunction with the 90° angle at the middle panel fold line 26 of the outer support panel 25 create a triangular support at each corner support 39 of the paperboard container 1. This combination contributes greater strength to the paperboard container 1 than a container without the combination.

FIGS. 3-11, particularly with the cross-sectional views, and FIGS. 14-20, particularly showing the steps used in assembling the paperboard container 1, are useful in identifying the locations of double- and triple-layer wall construction used in the paperboard container for increased strength as compared to single-wall container construction.

The FIGS. 1-23 also indicate the location of stacking tabs 28, 38 (which are received into tab receiving passageways 14), and side flap locking tabs 60 (which are received into the bottom tab slots 12), and the shoulder tabs 36 (which are received into shoulder lock slots 58) that are involved in stacking and locking the paperboard container 1 when assembled.

The inter-fitting elements at the top wall 50, end panel 40, and bottom panel 10 of the immediately adjacent lower and upper containers allow containers to be stacked for storage, display, and transport. The top wall section 51 provides at least a partial cover to protect produce (or other contents) contained in the paperboard container. The assembled container 1 is secured in an assembled form when bottom tab 60 is inserted into bottom tab slot 12.

The paperboard container 1 may be formed of any suitable materials, including, but not limited to cardboard, fiberboard (i.e., corrugated fiberboard), etc. In one embodiment, the paperboard container 1 is formed by first stamping the blank 2 out of paperboard and then imparting or scoring fold lines to the blank 2. The paperboard container 1 is preferably formed by an integrally-formed blank 2.

Water-resistant corrugated paperboard is manufactured and used for shipping produce, wet iced poultry, meat containers, and a variety of other end uses where the board is exposed to water or high humidity. Conventional water-resistant corrugated paperboard is generally prepared by first assembling the various layers of the corrugated paperboard in a corrugator using specially-formulated adhesives that have higher resistance to water than conventional paperboard adhesives.

Water-resistant paperboard adhesive is prepared through a variety of techniques that generally focus on a higher rate of carrier application and higher solids content. Stein-Hall adhesives are generally used for the water-resistant paperboard adhesive. As known in the art, a Stein-Hall adhesive uses a small portion of cooked carrier starch to suspend and carry uncooked starch. The Stein-Hall adhesive also uses caustic soda (sodium hydroxide) to help cook the carrier starch, and borax to increase tack and cohesiveness. These three raw materials, and water, are the main ingredients for all corrugating adhesives. Their consistency will affect the quality, stability, and running qualities of the finished adhesive.

A waterproofing agent may be of any type that is known in the art for coating corrugated paperboard. Typically, the waterproofing agent comprises a waxy material suspended in a solvent such as water. After drying the corrugated medium that are treated with the waterproofing agent, the solvent is removed with the waxy material remaining on or in the corrugated medium. One example of a suitable waxy material, for purposes of the instant invention, is polyethylene terephthalate (PET). However, it is to be appreciated that different waxy materials can be used, and it is to be further appreciated that different waterproofing agents may be used to treat the corrugated medium. Corrugated media formed in the presence of the waterproofing agent are readily known in the industry.

A preferred water resistant outside coating is SS 48 Spectra (Spectra-Kote Corporation, 301 E. Water Street, P.O. Box 3369, Gettysburg, Pa. 17325-0369). A preferred water resistant corrugated paperboard is Norshield waxless board (Cascades Containerboard Packaging, 55-15 Grand Avenue, Maspeth, N.Y., United States, 11378).

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A stackable paperboard container comprising:

a bottom panel;

a pair of side panels extending from the bottom panel and foldable about a side panel fold line, each side panel opposed to the other side panel of the pair of side panels;

a pair of end panels extending from the bottom panel and foldable about an outer end fold line, each end panel opposed to the other end panel of the pair of end panels;

a pair of side flaps, each side flap extending from one of a pair of side panels and foldable about a side flap fold line; and a pair of top walls, each top wall extending from one of pair of end panels and foldable about a top wall fold line and having:

a wall section;

a tab receiving passageway;

a pair of top wall flaps, each top wall flap extending from one side of the wall section and foldable about by a top flap fold line;

a pair of bottom locking tabs, each bottom locking tab extending from each of the pair of top wall flaps along a locking tab fold line and sized to be insertable into a bottom tab slot of the bottom panel; and a pair of outer support panels, each outer support panel extending from one of the pair of the side panels and foldable about a middle panel fold line and having a stacking tab sized corresponding with the tab receiving passageway positioned on the top wall.

2. The stackable paperboard container of claim 1, further comprising a pair of inner end panels, each inner end panel extending from one of the pair of the side flaps and foldable about a fold line B.

3. The stackable paperboard container of claim 2, wherein each inner end panel includes a stacking tab corresponding with the tab receiving passageway.

4. The stackable paperboard container of claim 3, further comprising a pair of bottom receiving passageways, each of the pair of bottom receiving passageways situated along the outer end fold line along the bottom panel.

5. The stackable paperboard container of claim 4, wherein the bottom receiving passageways corresponds with the stacking tab of one of a pair of the outer support panels and the stacking tab of one of the pair of the inner end panels located at each end panel of a separate stackable paperboard container.

6. The stackable paperboard container of claim 5, further comprising a plurality of ventilation passageways positioned along and through each of the pair of side panels, the pair of side flaps, the pair of top wall flaps, the pair of end panels, the pair of outer support panels, the pair of inner end panels, and the pair of top walls.

7. The stackable paperboard container of claim 5, further comprising a plurality of hand receiving passageways positioned along and through the pair of outer end panels, the pair of outer support panels, and the pair of inner end panels.

8. The stackable paperboard container of claim 7, wherein the plurality of hand receiving passageways correspond with each other at ends thereof.

9. The stackable paperboard container of claim 5, further comprising a pair of aperture passageways, each aperture passageway positioned generally centrally along a side flap fold line at the juncture of each side panel and each side flap.

10. The stackable paperboard container of claim 2, wherein each side panel includes a body section and a pair of outer support panels extending therefrom.

11. The stackable paperboard container of claim 10, wherein each side flap includes a body support and pair of inner end panels extending therefrom.

12. The stackable paperboard container of claim 11, wherein each side flap includes a pair of fold lines forming a support column.

13. The stackable paperboard container of claim 12, further comprising a corner support positioned formed between the body section, one of the pair of outer support panels, and the support column.

* * * * *